US009930941B1

(12) United States Patent
Sarauer

(10) Patent No.: US 9,930,941 B1
(45) Date of Patent: Apr. 3, 2018

(54) WALKING AID SYSTEM AND METHOD

(71) Applicant: Rodney Philip Sarauer, Edmonton (CA)

(72) Inventor: Rodney Philip Sarauer, Edmonton (CA)

( * ) Notice: Subject to any disclaimer, the term of this patent is extended or adjusted under 35 U.S.C. 154(b) by 0 days.

(21) Appl. No.: 15/275,142

(22) Filed: Sep. 23, 2016

(51) Int. Cl.
*A45B 3/04* (2006.01)
*A45B 9/02* (2006.01)
*A45B 9/04* (2006.01)
*A45B 9/00* (2006.01)

(52) U.S. Cl.
CPC ..... *A45B 3/04* (2013.01); *A45B 9/02* (2013.01); *A45B 9/04* (2013.01); *A45B 2009/002* (2013.01); *A45B 2009/007* (2013.01); *A45B 2009/025* (2013.01); *Y10S 135/91* (2013.01)

(58) Field of Classification Search
CPC ..... A61H 3/00; A61H 2201/5007; A61H 2201/5023; Y10S 135/91; A45B 3/00; A45B 3/04; A45B 9/04; A45B 3/02; A45B 2009/007
USPC ..... 135/65–66, 68, 72, 75, 86, 911, 910; 340/573.1; 701/468, 488, 412
See application file for complete search history.

(56) References Cited

U.S. PATENT DOCUMENTS 4,625,742 A 12/1986 Phillips
4,986,295 A * 1/1991 Kellner ..... A45B 3/00 135/66
6,152,491 A * 11/2000 Queentry ..... A63C 11/225 280/819
6,394,116 B1 5/2002 Winn et al.
6,745,786 B1 * 6/2004 Davis ..... A45B 3/00 135/65
6,774,795 B2 * 8/2004 Eshelman ..... A61B 5/0002 340/539.1
8,517,555 B1 * 8/2013 LeJeune ..... A45B 3/04 135/65
8,985,802 B2 3/2015 Nievas
9,131,753 B2 * 9/2015 Chien ..... A45B 3/04
9,155,675 B2 * 10/2015 Ye ..... A61H 3/061
9,161,595 B2 10/2015 Riemer
9,468,272 B1 * 10/2016 Hyde ..... A61H 3/02
2005/0211284 A1 * 9/2005 Dooley ..... A45B 3/00 135/65
2008/0251109 A1 * 10/2008 Lee ..... A45B 3/00 135/66
2009/0056777 A1 3/2009 Lawhead
(Continued)

*Primary Examiner* — Winnie Yip
(74) *Attorney, Agent, or Firm* — Integrity Patent Group, PLC; Edwin Wold

(57) ABSTRACT

An illuminated walking assistance apparatus. The illuminated walking assistance apparatus is made in the form of a staff having a light pipe in the lower portion thereof which provides diffused illumination in the immediate vicinity of the apparatus and at the same time, a bright light visible for a substantial distance to alert or signal others. A walking aid that may include an elongated support shaft to be used as a walking support. The length of the support shaft may extend between an upper end and a lower end. At the upper end of the elongated support shaft, the walking aid support may include a handle assembly that includes a hand grip. The walking aid may include a light source having a user interface that may be designed to selectably emit light outward from the elongated support shaft.

17 Claims, 5 Drawing Sheets

(56) References Cited

U.S. PATENT DOCUMENTS

| | | | | |
|---|---|---|---|---|
| 2013/0346021 | A1* | 12/2013 | Stevens | A45B 3/00<br>702/160 |
| 2014/0053887 | A1* | 2/2014 | Lee | A45B 9/04<br>135/66 |

* cited by examiner

WALKING AID SYSTEM AND METHOD

BACKGROUND OF THE INVENTION

The following includes information that may be useful in understanding the present disclosure. It is not an admission that any of the information provided herein is prior art, or material, to the presently described or claimed inventions, or that any publication or document that is specifically or implicitly referenced is prior art.

1. Field of the Invention

The present invention relates generally to the field of mobility assistance devices and more specifically relates to walking aid systems.

2. Description of Related Art

Disabled and elderly persons often require aids that assist in walking. Walking can be even more challenging in dark areas. While it is possible to carry a flashlight, this occupies the walker's hands and limits their use. Headlamps provide hands-free lighting, however they can be uncomfortable and even unsightly in certain environments. The related art pertains to mobility assistance devices such as canes, sticks, crutches, and walking aids and illuminated canes or umbrellas.

Several attempts have been made to solve the above-mentioned problems such as those found in U.S. Pat. No. 6,394,116 to Winn et al.; U.S. Pat. No. 9,161,595 to Riemer, U.S. Pat. No. 8,517,555 to LeJeune; U.S. Pat. No. 4,625,742 to Phillips; U.S. Pat. No. 8,985,802 to Nievas; and U.S. Pub. No. US 2009/0056777 to Lawhead. This art is representative of mobility assistance devices. However, none of the above references, taken either singly or in combination, is seen to describe the invention as claimed.

BRIEF SUMMARY OF THE INVENTION

In view of the foregoing disadvantages inherent in the known mobility assistance device art, the present disclosure provides a novel walking aid system. The general purpose of the present disclosure, which will be described subsequently in greater detail is to provide a walking aid that is capable of emitting ambient light for increased safety or aesthetic purposes.

A walking aid is disclosed herein. The walking aid includes an elongated support shaft configured as a walking support, and having an upper end, a lower end, and a length, the length extending between the upper end and the lower end. The walking aid further includes a handle assembly fixed to the upper end of the elongated support shaft, and the handle assembly including a hand grip. The walking aid further includes a shaft boot fixed to the lower end of the elongated support shaft, the shaft boot configured to contact a walking surface during walking. The walking aid further includes a light source fixed to the elongated support shaft, the light source configured to emit ambient light from the elongated support shaft. The walking aid further includes a user interface configured to selectably operate the light source.

A method of using a walking aid system is disclosed herein. The method of using a walking aid system includes the steps of installing a DC power supply, selecting a light source via the user interface, placing a wrist through the retainer and securing a grip about the handle grip, ambulating with the walking aid, and deactivating said light source via said color selector.

The present disclosure may offer significant improvements and serves as a walking aid system. Preferably, a mobility assistance device should provide a walking aid that is capable of emitting ambient light for increased safety or aesthetic purposes and, yet would operate reliably and be manufactured at a modest expense. Thus, a need exists for a reliable walking aid system to avoid the above-mentioned problems.

For purposes of summarizing the disclosure, certain aspects, advantages, and novel features of the disclosure have been described herein. It is to be understood that not necessarily all such advantages may be achieved in accordance with any one particular embodiment of the disclosure. Thus, the disclosure may be embodied or carried out in a manner that achieves or optimizes one advantage or group of advantages as taught herein without necessarily achieving other advantages as may be taught or suggested herein. The features of the disclosure which are believed to be novel are particularly pointed out and distinctly claimed in the concluding portion of the specification. These and other features, aspects, and advantages of the present disclosure will become better understood with reference to the following drawings and detailed description.

BRIEF DESCRIPTION OF THE DRAWINGS

The figures which accompany the written portion of this specification illustrate embodiments and method(s) of use for the present disclosure, walking aid system, constructed and operative according to the teachings of the present disclosure.

The various embodiments of the present disclosure will hereinafter be described in conjunction with the appended drawings, wherein like designations denote like elements.

DETAILED DESCRIPTION

Figure 1:
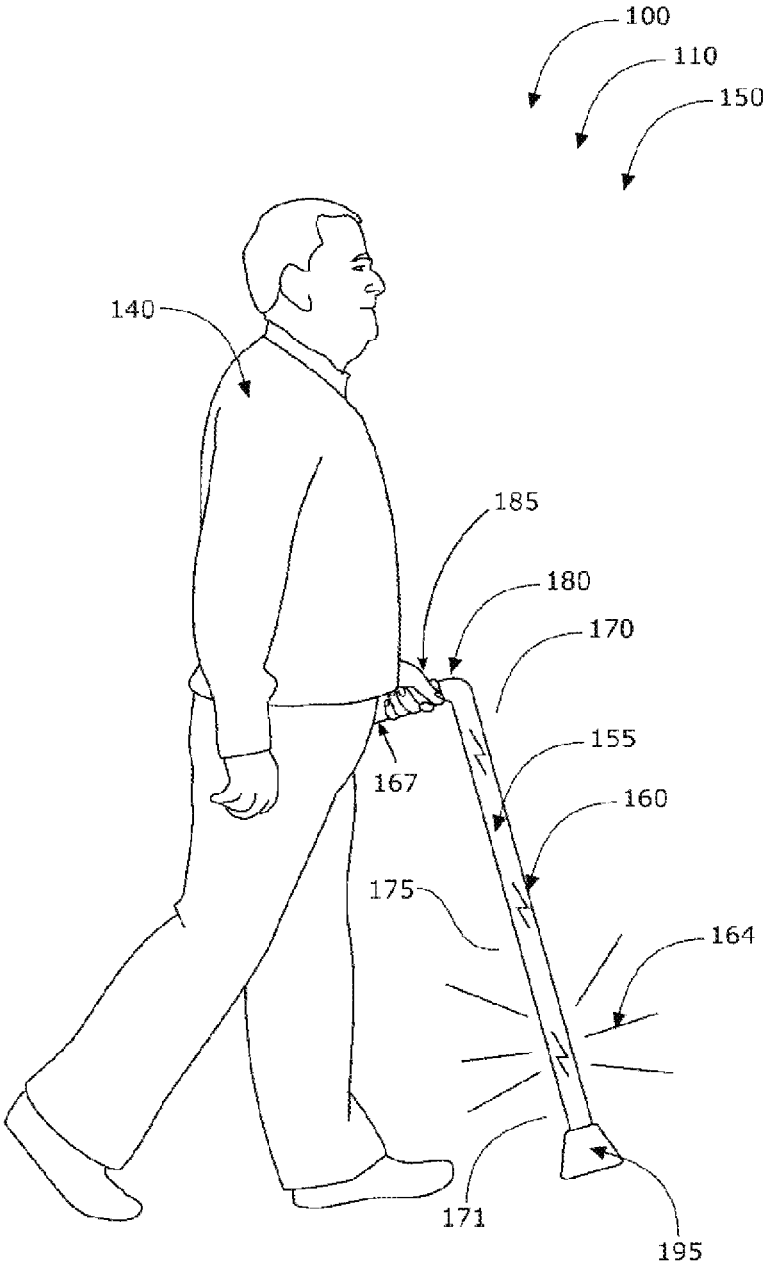
FIG. 1 is a side view, illustrating a walking aid system during an 'in-use' condition, according to an embodiment of the disclosure.

As discussed above, embodiments of the present disclosure relate to a mobility assistance device and more particularly to a walking aid system as used to improve a walking aid that is capable of emitting ambient light for increased safety or aesthetic purposes.

Generally speaking, the walking aid system may include a cane or walking stick that is made in part from clear materials along with a light source attached to it that makes the walking stick light up in a variety of colors. This not only makes the walking aid safer to use as dark roadways or rooms can be more easily traversed as a result of the ambient light being emitted from the cane, but it also provides an aesthetic alternative to traditional walking aids.

The walking aid system may be particularly useful in areas and at events where a flashlight beam to provide light for walking would be disruptive. During the day, the walking aid system can be used strictly as a cane, while at night it can be used both as a cane and as an implement that can assist with safer walking by illuminating the walking path. For example, a person may be attending an outdoor even that does not have full light coverage of walkways and to the parking area, so the user may activate the light feature to better see the walkways and other darkened paths. One alternative configuration could include a modified end piece that features an ice pick, to enhance or replace the shaft boot for increased traction in icy conditions. Other alternative configurations may feature a plurality of shaft diameters and/or materials to accommodate users of different dimensions, ages, and capabilities.

The walking aid system may have an elongated support shaft that may be at least partially made of translucent material that may be configured as a walking support having an upper end, a lower end, a length, and a height. The length may lie between the upper end and the lower end and the height is derived from the length. The height is generally understood to be measured from a floor to the location of the user's hand (e.g. the grip or the upper end). The elongated support shaft may also be adjustable in length providing a minimum and maximum height.

The walking aid system may include a handle assembly including a grip made possibly from elastomeric materials, which may be fixed to the upper end of the elongated support shaft in a manner that makes it easy for a user to retain hold of the handle assembly. In addition, the handle assembly may be configured to be capable of supporting at least 100-200 lbs. of force applied to the handle.

The handle assembly may further include an open-end receiver and a retainer, which may be configured to be removably-secured around the wrist of a user. At the lower end of the elongated support shaft, the device may have a frictionally secured shaft boot that may be made at least partially from non-slip materials and may be configured for direct contact with the walking surface (e.g., the floor) while in use.

In addition, the elongated support shaft may have a selectable light source that may be configured to emit an ambient light emanating from the elongated support shaft. This light source may have a user interface configured to selectably operate the light source and may also feature a color selector that allows a user to choose from, for example, between one and ten selectable illumination configurations. After a selection is made, the elongated support shaft may be designed to optically channel the selected color of light from the light source down the length of the elongated shaft towards the shaft boot in a manner that may produce an ambient lighting effect around the shaft. The light source itself may be at least partially retained inside the open-end receiver of the handle assembly and may be powered by an energy storage that may include a DC power supply. The DC power supply may be removably electrically-coupleable to the light source, and may further include one or more rechargeable batteries.

Referring now more specifically to the drawings by numerals of reference there is shown in FIGS. 1-4, various views of a walking aid system 100. In a preferred embodiment the walking aid system 100 includes an elongated support shaft made of translucent material configured as a walking support having an upper end, a lower end, and a length, where the length may lie between the upper end and the lower end. The elongated support shaft may also be adjustable in length between a minimum and maximum height.

The walking aid system may also have a handle assembly including a grip made possibly from elastomeric materials that may be fixed to the upper end of the elongated support shaft in a manner that makes it easy for a user to retain hold of the handle assembly. The handle assembly may be capable of supporting at least 200 lbs. of force. The handle assembly may further include an open-end receiver and a retainer that may be configured to be removably-secured around the wrist of a user. At the lower end of the elongated support shaft the device may have a shaft boot made at least partially from non-slip materials and configured for direct contact with the walking surface while in use.

In addition, the elongated support shaft may have a selectable light source that may be configured to emit ambient light from its surface. This light source may have a user interface that regulates its operation and may also feature a color selector that allows a user to choose from up to at least 10 different predetermined colors. After a selection is made, the light source may be designed to optically channel the selected color of light from the light source down the length of the elongated shaft towards the shaft boot in a manner that may produce an ambient lighting effect. The light source itself may be retained inside the open-end receiver of the handle assembly and may be powered by an energy storage that may include a DC power supply having at least one rechargeable battery. The walking aid system may further include a set of user instructions, with the entire system being arranged as a kit.

FIG. 1 is a front view of a walking aid assembly 110 during an 'in-use' condition 150. The walking aid assembly 110 may include a light source 167 fixed to an elongated support shaft 160, a handle assembly 180, and a shaft boot 195.

As shown here, the walking aid assembly 110 may include a walking support 155 having an elongated support shaft 160 and a light source 167 capable of emitting ambient lighting 164, which a user 140 can choose from selectable illumination configurations (e.g., on, off, bright through dim, strobe, focused, diffused/ambient, etc.), and a color selector 169 configured to selectably emit the light in a plurality of colors (e.g., between color selections "one" through "ten") and in response to the color selector 169.

The walking aid assembly 110 may have an upper end 170, a lower end 171, and a length 175 extending therebetween. The user 140 may hold on to hand grip 185 surrounding the handle assembly 180 at the upper end 170 of the length 175 of the elongated support shaft 160 while transferring load through the length 175 to the shaft boot 195 at its lower end 171, allowing the user 140 to walk comfortably and with light available. According to one embodiment, the shaft boot 195 may be frictionally secured to the lower end 171 of the elongated support shaft 160.

Figure 2:
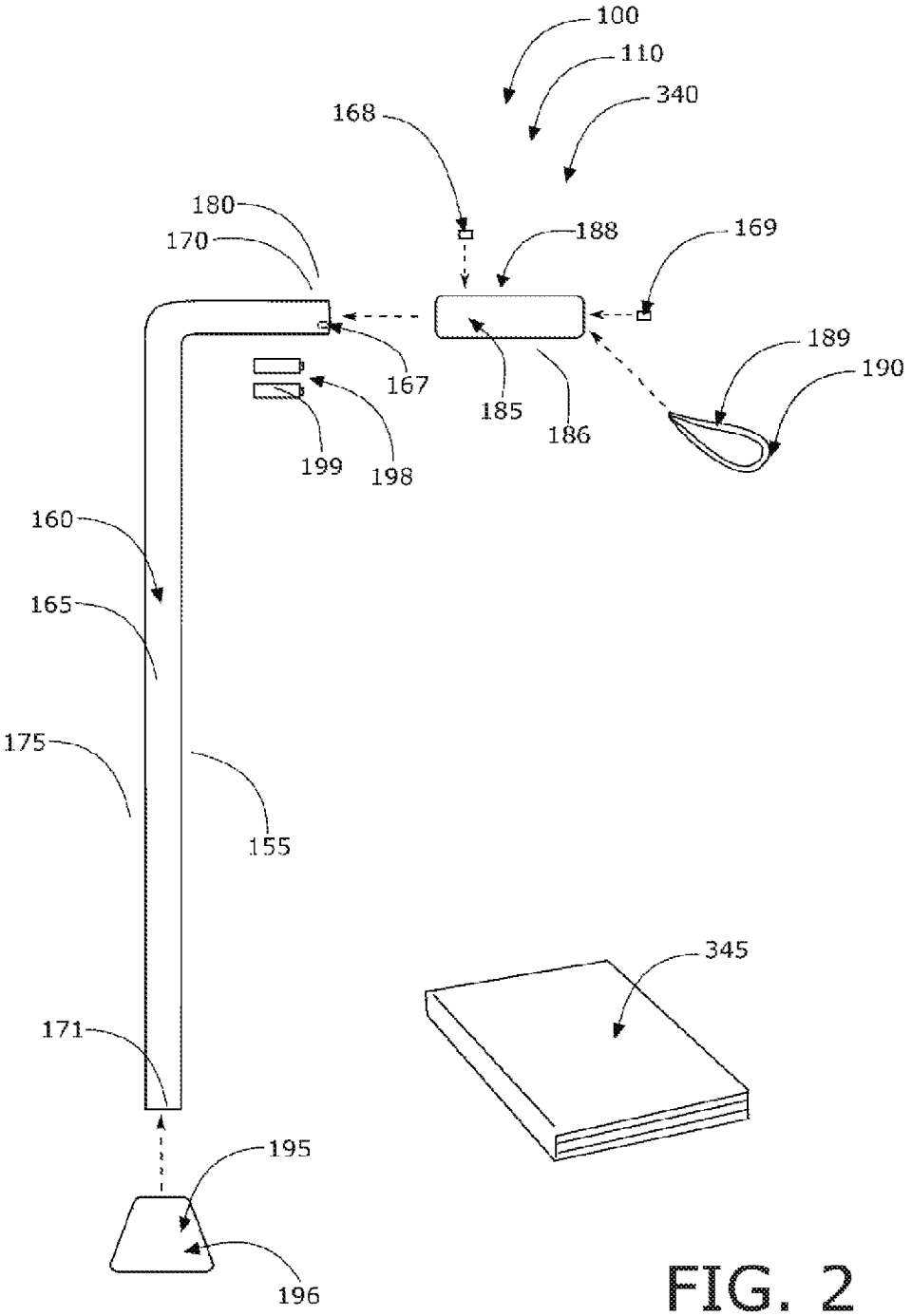
FIG. 2 is an exploded view, illustrating the walking aid system of FIG. 1, according to an embodiment of the present disclosure.

FIG. 2 is an exploded view of the walking aid assembly 110 in a preferred embodiment of the present disclosure. Here, the length 175 of the elongated support shaft 160 extends between the upper end 170 to the lower end 171 and may be made at least partially of translucent material 165 and generally has an L-shape.

The handle assembly 180 may include an open-end receiver 188 configured to couple to the upper end 170 of the elongated support shaft 160. The handle assembly 180 may further include a retainer 189, which may be at least partially made of flexible materials 190. The retainer 189 may be configured to removably secure the walking support 155 to a wrist of the user 140 (FIG. 1).

As above, the light source 167 may include a user interface 168 and color selector 169. The user interface 168 may be configured to operate the light source 167 according to selectable illumination configurations. Likewise, the color selector 169 may be configured to operate the light source 167 according to selectable color configurations. The light source 167 may be powered by an onboard energy storage 198. In particular, the energy storage 198 may include a DC power supply 199 such as batteries. According to one embodiment, the light source 167 and/or the energy storage 198 may be at least partially embedded in at least one of the handle assembly 180 and the elongated support shaft 160.

The shaft boot 195 may be constructed at least partially from non-slip materials 196 and may be frictionally secured to the lower end 171 of the elongated support shaft 160. Similarly, the hand grip 185 may be at least partially made of elastomeric materials 186, and may be attached to the handle assembly 180.

The walking aid system 100 may be arranged as a kit 340 including the following parts: at least one walking aid assembly 110 and at least one set of user instructions 345. The kit 340 has instructions 345 such that functional relationships are detailed in relation to the structure of the disclosure (such that the disclosure can be used, maintained, or the like in a preferred manner).

Figure 3:
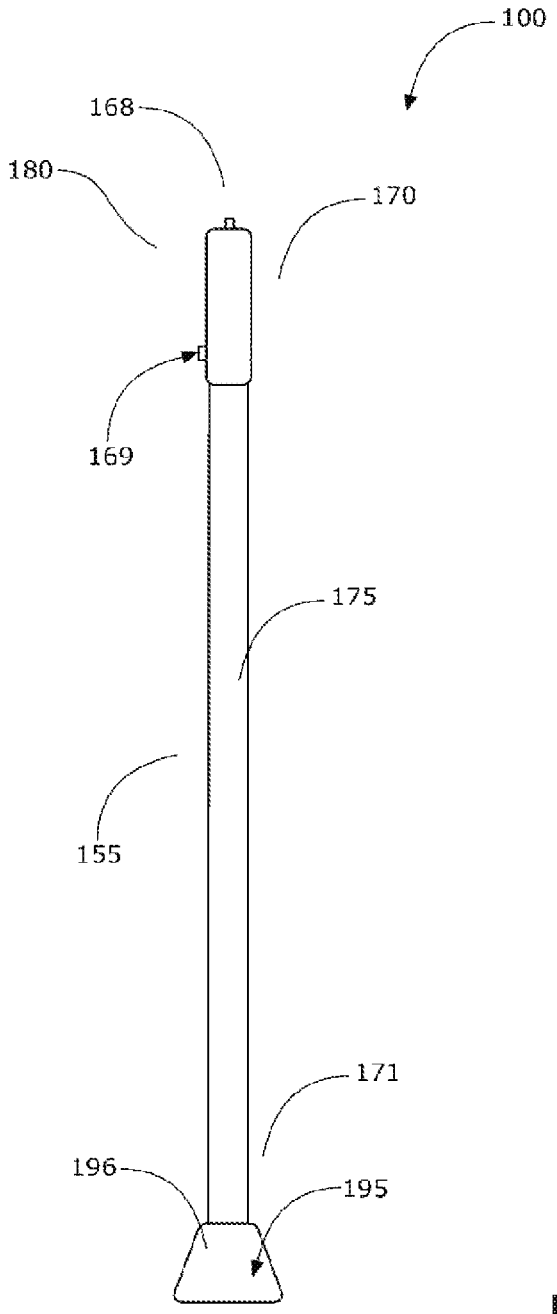
FIG. 3 is a front view, illustrating the walking support according to an embodiment of the present disclosure.

FIG. 3 shows an alternate embodiment of the walking aid system 100. In this embodiment the walking support 155 may be configured as a straight member (i.e., without a bend proximate the handle assembly 180). In particular, the walking support 155 may extend linearly down the length 175 from the upper end 170 to the lower end 171. In contrast to FIG. 2, here the handle assembly 180 is generally in a vertical in-use configuration rather than a horizontal in-use configuration. Also in contrast to FIG. 2, here the user interface 168 is moved to the top of the handle assembly 180, and the color selector 169 is moved to a side of the handle assembly 180. Here, the walking aid system 100 may be configured to emit more light in the forward facing direction. This configuration may be designated as a left hand version as it has controls proximate the thumb of the left hand. It is understood, the walking aid system 100 can be configured as a right hand version, as well as an ambidextrous version (e.g., here where light emission is constant and omnidirectional. Likewise, the thumb controls may be switched between the user interface 168 and the color selector 169.

Figure 4:
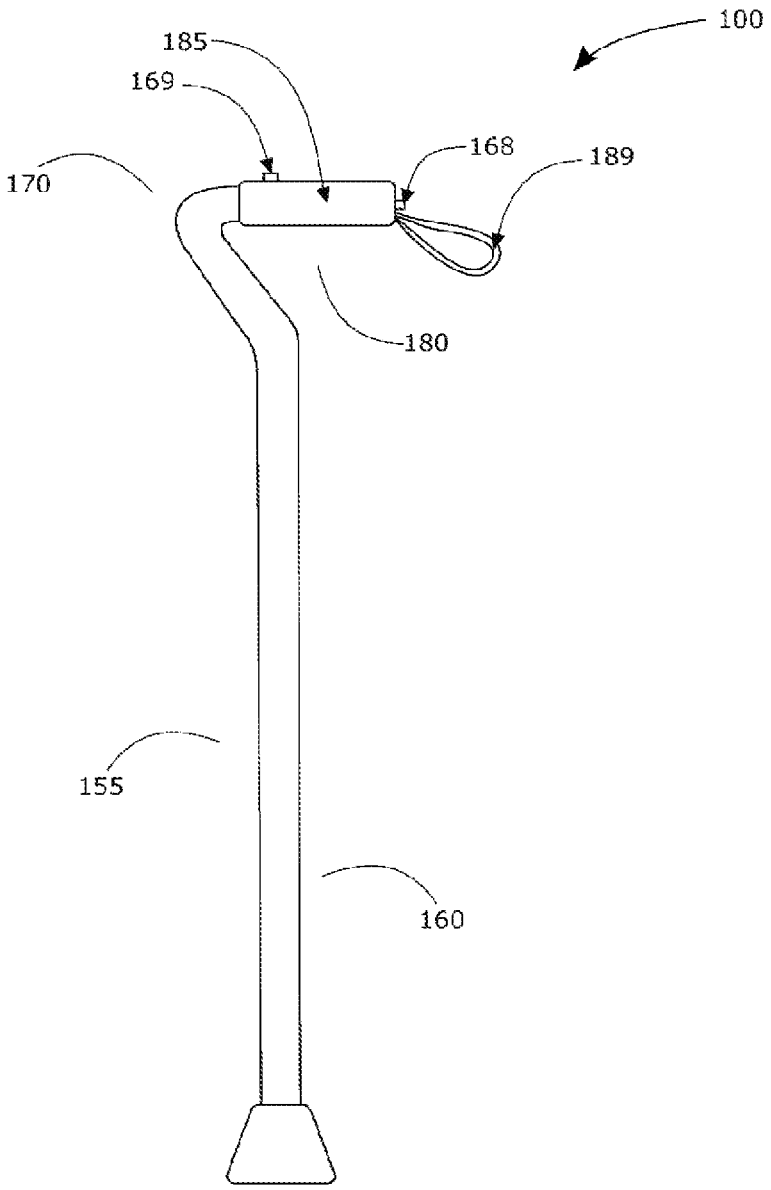
FIG. 4 is a side view, illustrating a walking support with a bent portion proximate the handle assembly, according to another embodiment of the present disclosure.

FIG. 4 shows an additional embodiment of the walking aid system 100. In particular, the walking support 155 that may include an acutely-bent portion proximate the handle assembly and straight span along the length in the elongated support shaft 160 in a manner such that the user 140 (FIG. 1) may hold on to the hand grip 185 of the handle assembly 180 that may aligned down the center of the shaft when the shaft is held perpendicular to the walking surface. The handle assembly 180 is shown in an ambidextrous configuration relative to the positioning of the user interface 168 and the color selector 169.

Walking aid system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

According to another embodiment, a method for using walking aid systems is also disclosed herein. The method for providing the walking aid system includes the steps of: installing a DC power supply, selecting a light source via the user interface, selectably emitting light in a plurality of colors, placing a wrist through the retainer and securing a grip about the handle grip, ambulating with the walking aid system, deactivating the light source via the color selector, and recharging the batteries of the DC power supply.

Figure 5:
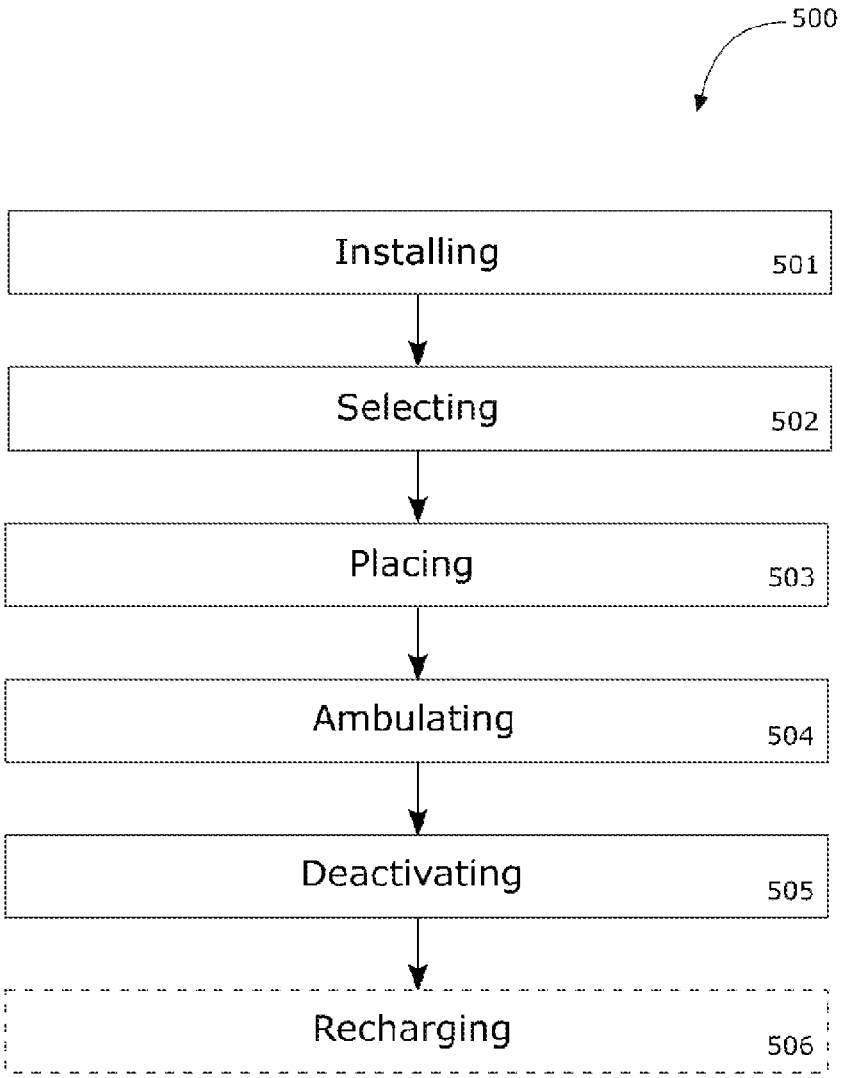
FIG. 5 is a flow diagram illustrating a method of use for the walking aid system according to an embodiment of the present disclosure.

Referring now to FIG. 5 showing a flowchart illustrating method of use 500 for the walking aid system 100 described above in FIGS. 1-4. As shown, method of use 500 may include the steps of: step one 501, installing a DC power supply; step two 502, selecting and operating a light source via the user interface and the color selector; step three 503, placing a wrist through the retainer and securing a grip about the handle grip; step four 504, ambulating with the walking aid assembly; step five 505, deactivating the light source via the user interface; and step six 506, recharging the batteries of the DC power supply.

It should be noted that step six 506 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. §112 (f). Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the disclosure described herein are exemplary and numerous. Modifications, variations and rearrangements can be readily envisioned to achieve substantially equivalent results, all of which are intended to be embraced within the spirit and scope of the disclosure. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A walking aid comprising:

a) an elongated support shaft configured as a walking support, said elongated support shaft having an upper end, a lower end, and a length, said length extending between said upper end and said lower end;

b) a handle assembly fixed to said upper end of said elongated support shaft, and said handle assembly including a hand grip;

c) a shaft boot fixed to said lower end of said elongated support shaft, said shaft boot configured to contact a walking surface during walking by a user;

d) a light source fixed to said elongated support shaft, said light source configured to emit ambient light from said elongated support shaft;

e) a user interface configured to selectably operate the light source;

f) a color selector structured and arranged with said light source to selectably emit an ambient light in a plurality of colors when the user manipulates said color selector; and g) wherein said elongated support shaft is further configured to optically channel light from said light source through said length toward said shaft boot.

2. The walking aid of claim 1, wherein said elongated support shaft is at least a partially made of a translucent material.

3. The walking aid of claim 1, wherein said shaft boot is at least partially made of non-slip materials, and is frictionally secured to said lower end of said elongated support shaft.

4. The walking aid of claim 1, wherein said walking aid is configured to support at least 200 lbs. of force applied to said handle assembly.

5. The walking aid of claim 1, wherein said handle grip is at least partially made of elastomeric materials, and is configured for the user to retain hold of said handle assembly.

6. The walking aid of claim 1, wherein the light source has between one and ten selectable illumination configurations.

7. The walking aid of claim 1, wherein the handle assembly further includes an open-end receiver and a retainer, said open-end receiver configured to couple to said upper end of said elongated support shaft, and said retainer is at least partially made of flexible materials and is configured to be removably-secured about a wrist of the user.

8. The walking aid of claim 7, wherein said light source is at least partially retained inside said open-end receiver of said handle assembly.

9. The walking aid of claim 1, further comprising an energy storage configured to power said light source.

10. The walking aid of claim 9, wherein said energy storage includes a DC power supply.

11. The walking aid of claim 10, wherein said DC power supply includes one or more rechargeable batteries.

12. The walking aid of claim 10, wherein said DC power supply is removably electrically-coupleable to said light source.

13. The walking aid of claim 1, wherein said elongated support shaft includes a bent portion proximate the handle assembly and straight span along the length.

14. A walking aid system comprising:

a) an elongated support shaft configured as a walking support, said elongated support shaft having an upper end, a lower end, and a length, said length extending between said upper end and said lower end;

b) a handle assembly fixed to said upper end of said elongated support shaft, and said handle assembly including a hand grip;

c) a shaft boot fixed to said lower end of said elongated support shaft, said shaft boot configured to contact a walking surface during walking;

d) a light source fixed to said elongated support shaft, said light source configured to emit ambient light from said elongated support shaft; and e) a user interface configured to selectably operate said light source;

f) wherein said elongated support shaft is at least a partially made of a translucent material;

g) wherein said shaft boot is at least partially made of non-slip materials, and is frictionally secured to said lower end of said elongated support shaft;

h) wherein said length of the said elongated support shaft is adjustable between a minimum height and a maximum height;

i) wherein said walking aid is configured to support at least 200 lbs. of force applied to said handle assembly;

j) wherein said handle grip is at least partially made of elastomeric materials, and is configured for a user to retain hold of said handle assembly;

k) wherein said walking aid further comprises a color selector;

l) wherein said light source is further configured to selectably emit the ambient light in a plurality of colors and in response to said color selector;

m) wherein said light source has between one and ten selectable illumination configurations;

n) wherein said handle assembly further includes an open-end receiver and a retainer, said open-end receiver configured to couple to said upper end of said elongated support shaft, and said retainer is at least partially made of flexible materials and is configured to be removably-secured about a wrist of said user;

o) wherein said light source is at least partially retained inside said open-end receiver of said handle assembly;

i) wherein said walking aid further comprising an energy storage configured to power said light source;

ii) wherein said energy storage includes a DC power supply;

iii) wherein said DC power supply includes one or more rechargeable batteries;

p) wherein said DC power supply is removably electrically-coupleable to said light source; and q) wherein said elongated support shaft is further configured to optically channel light from said light source through the length toward said shaft boot.

15. The walking aid system of claim 14, further comprising a set of user instructions; and a) wherein the walking aid system is arranged as a kit.

16. A method of using the walking aid system of claim 14, the method comprising the steps of:

a) installing a DC power supply including batteries;

b) selecting and operating the light source via the color selector and the user interface;

c) placing the retainer to a wrist of a user and securing the hand grip about the upper end of the elongated support shaft;

d) ambulating with the walking aid system; and e) deactivating said light source via said user interface.

17. The method of claim 16 further comprising the step of recharging the batteries of the DC power supply.

* * * * *